United States Patent [19]

Lou

[11] 4,272,754

[45] Jun. 9, 1981

[54] THIN FILM VARISTOR

[75] Inventor: Liang F. Lou, Liverpool, N.Y.

[73] Assignee: General Electric Company, Auburn, N.Y.

[21] Appl. No.: 104,564

[22] Filed: Dec. 17, 1979

[51] Int. Cl.[3] ..... H01C 7/10

[52] U.S. Cl. ..... 338/21; 29/610 R; 338/309

[58] Field of Search ..... 338/20, 21, 314, 308, 338/307, 309; 252/518; 29/610, 620; 361/39, 40, 127; 427/101-103

[56] References Cited

U.S. PATENT DOCUMENTS

| | | | |
|---|---|---|---|
| 1,927,894 | 9/1933 | Krause | 338/21 |
| 2,173,625 | 9/1939 | Fujitaka et al. | 361/127 |
| 2,870,307 | 1/1959 | Milliken et al. | 338/21 |
| 3,764,951 | 10/1973 | Tachibana | 338/21 X |
| 3,845,358 | 10/1974 | Anderson et al. | 338/21 X |
| 3,913,056 | 10/1975 | Levinson | 338/21 |
| 4,212,045 | 7/1980 | Martzloff | 361/127 |

*Primary Examiner*—C. L. Albritton

*Attorney, Agent, or Firm*—Robert J. Mooney; Stephen B. Salai

[57] ABSTRACT

A thin film metal oxide-metal oxide heterojunction nonlinear resistor is described. A non-symmetrical embodiment wherein zinc oxide and bismuth oxide are employed provides exemplary nonlinear characteristics for triggering or transient suppression applications. A symmetrical embodiment which includes a sandwich-like structure of one metal oxide between layers of a second metal oxide provides similar characteristics in a symmetrical form.

20 Claims, 5 Drawing Figures

THIN FILM VARISTOR

This invention relates in general to nonlinear resistors and more particularly to a thin film heterojunction resistor including one or more zinc oxide-bismuth oxide junctions.

Metal oxide varistors provide an important non-linear resistor component which have become increasingly widely employed as transient voltage suppressors. Among the important characteristics are the highly symmetrical and nonlinear voltage-current characteristics of the device as well as the large energy handling capabilities. The range of applications for such metal oxide varistors extends from small, relatively low energy devices which may be included within a particularly sensitive piece of electrical equipment to very high energy devices suitable for diverting lightning strokes away from the power distribution equipment. The characteristics of ceramic metal oxide varistors and especially zinc oxide varistors have been extensively characterized. In the pioneering paper of Matsuoka et al, JAPAN JOURNAL OF APPLIED PHYSICS 39,94(1970) the fundamental electrical and micro structural characteristics of metal oxide varistors are described. A model is proposed therein, which includes n-type semiconducting zinc oxide grains interconnected by highly resistive bismuth oxide enriched intergranular layers of varying thickness. Originally, ceramic metal oxide varistors are formed as pellets of varying sizes having on opposed major surfaces thereof, contacts of electrically conducting material. The characteristics of such a varistor depend upon its composition as well as its physical dimensions. High voltage, high energy varistors are typically large, wherein low voltage, low energy varistors may be somewhat smaller. Additionally, lower voltage devices are preferably formed by varying the composition thereof to produce larger zinc oxide grains. It has been suggested, for example, by Matsuoka, JAPAN JOURNAL OF APPLIED PHYSICS, 10,736(1971), that the varistor device can be viewed as a network of zinc oxide-bismuth oxide junctions in series and parallel. There is no universally accepted model for metal oxide varistor operation, however.

While ceramic metal oxide varistors offer many advantages and have found application in a wide variety of surge suppression uses, they are not readily employable in all cases where a voltage limiting function is required. For example, integrated circuits which contain many hundreds or thousands of individual components in a single device and which include a plurality of input, output, and control terminals would require a large number of varistors for complete protection against transient voltages. Varistors according to the prior art could, of course, be employed and would, from a technical standpoint, provide adequate protection in some cases. However, the practical considerations of connecting a large number of such varistors to an integrated circuit along with the additional size and weight which would be imposed, rule out discrete varistors as have been known heretofore as a practical method for protecting such devices. It would be useful, therefore, to provide the same function as is currently provided by ceramic metal oxide varistors in a form compatible with integrated circuit and large scale integrated circuit devices.

Additionally, some applications, notably triggering functions for optical displays, could beneficially employ varistors if the cost could be reduced. This is an application which does not utilize the energy absorbing characteristics of a varistor to protect another device, but rather uses the V-I characteristics of the varistor to provide an enabling signal for triggering a display. In this application a large sheet of varistor material could be advantageously employed, or in the alternative, a plurality of discrete low power varistors on a single substrate would be useful.

It is an object of this invention to provide a nonlinear resistor of extremely small size which may conveniently be employed to protect a single semiconductor device or integrated circuit.

It is another object of this invention to provide a nonlinear resistor characterized by a single hetrojunction and first and second electrodes in essentially ohmic contact with the junction elements.

It is still another object of this invention to provide a nonlinear resistor which can be manufactured in a large sheet of continuous varistor material or as an easy to manufacture substrate having a large plurality of discrete varistors formed thereon.

Briefly stated and in accordance with a presently preferred embodiment of this invention, a nonlinear resistor comprises a first metallic electrode which is preferably a zinc electrode, a first semiconductor layer on said electrode and in ohmic contact therewith, said semiconductor layer preferably being of zinc oxide; a layer of bismuth oxide on the zinc oxide layer forming a hetrojunction therebetween; and a second metallic electrode on the layer of bismuth oxide in ohmic contact therewith, the second electrode preferably being a silver electrode. The nonlinear heterojunction device just described is preferably formed by consecutively sputtering thin layers of the zinc, zinc oxide, bismuth oxide and silver elements. At some time during the formation of the structure by consecutive sputtering of the several layers, the heterojunction is annealed at a temperature of about 350° for a few seconds to one or more hours to oxidize the bismuth oxide layer. The breakdown voltage of a heterojunction as described is in the range of 2.3 to 3 volts.

In accordance with another aspect of this invention, a nonlinear resistor having symmetrical characteristics is formed essentially as described but with the addition of a third layer of zinc oxide overlaying the layer of bismuth oxide to form a zinc oxide-bismuth oxide-zinc oxide sandwich structure. A second zinc electrode is employed to contact the second zinc oxide layer. Formation of the device proceeds as before with the consecutive sputtering of the several layers and electrodes followed by the heat treating step.

The features of the invention which are believed to be novel are pointed out with particularity in the appended claims. The invention itself, however, both as to its organization and method of operation together with further objects and advantages thereof may best be understood by reference to the following description taken in connection with the accompanying drawings in which:

Figure 1:
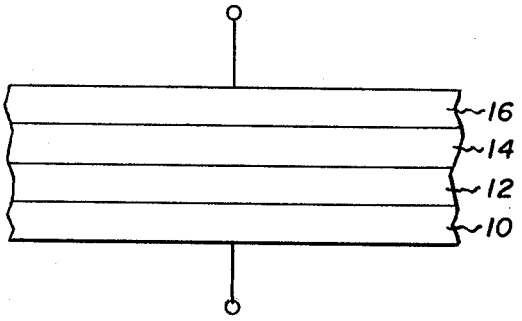
FIG. 1 is a section view of a multilayer thin film nonlinear resistor in accordance with one aspect of this invention.

Referring now to FIG. 1, a 4-layer thin film nonlinear resistor is illustrated. First layer 10 comprises a layer of zinc preferably having a thickness between about 500 and 2000 Å and no greater than a few microns. Layer 10 may conveniently be formed by sputtering on an appropriate substrate (not illustrated). The thickness of layer 10 should be great enough so that the layer is continuous. No particular advantage derives from especially thick layers, but neither is any adverse effect apparent. A suitable substrate may be formed of fused quartz or the like, selected to be relatively inert with respect to the zinc electrode. Second layer 12 comprises a layer of zinc oxide preferably having a thickness of between about 1000 Å and about 10,000 Å. Zinc oxide layer 12 may also be formed by sputtering, over zinc layer 10. Third layer 14 is a bismuth oxide layer which is preferably a $Bi_2O_3$ layer sputtered over zinc oxide layer 12. Bismuth oxide layer 14 preferably has a thickness between about 3000 and about 10,000 Å. After layers 10, 12 and 14 are formed as described, the resulting structure is heated to a temperature of about 350° C. for between about 30 seconds and several hours. This heating of the zinc oxide-bismuth oxide structure oxidizes the bismuth oxide layer 14 and provides the nonlinear characteristics of the hetrojunction formed at the interface of layers 12 and 14. After the heating step has been completed, layer 16 which is a second electrical contact is formed preferably by sputtering over layer 14. Layer 16 may conveniently be a silver layer. Layer 16 is preferably selected to have a thickness between about 1000 and about 5000 Å, it being understood that relatively thicker layers may be employed without detracting from the operation of the device but are felt to be essentially unnecessary.

It is preferred, in accordance with this invention, that the heat treating step be carried out prior to applying the silver electrode because silver and bismuth oxide react strongly at elevated temperatures.

In addition to oxidizing the bismuth oxide layers of a nonlinear resistor of this invention, heat treatment changes the character of the bismuth oxide layer from a bismuth enriched layer to a stoichiometric $Bi_2O_3$ layer and thereby provides improved performance.

Figure 2:
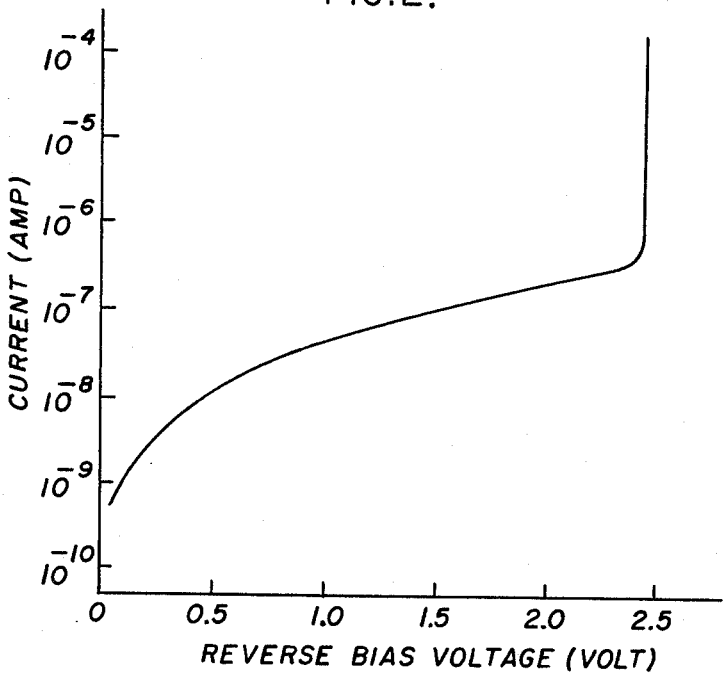
FIG. 2 is a graphical representation of the voltage-current characteristics of the device of FIG. 1.

FIG. 2 is a graphical representation of the relationship between current and voltage for device of the type shown in FIG. 1. It will be seen that below a threshold voltage which in this case is about 2.47 volts, the current through the device is very low and that above the threshold voltage, the current increases rapidly with little increase in voltage. In fact, the sharpness of the breakdown is much greater than that of a conventional ceramic metal oxide varistor.

Figure 3:
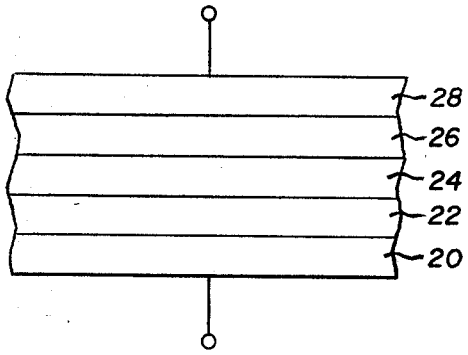
FIG. 3 is a section view of a symmetrical multilayer thin film nonlinear resistor in accordance with another aspect of this invention.

FIG. 3 illustrates in a section view, a symmetrical thin film nonlinear resistor in accordance with this invention. Lower layers 20, 22, and 24 correspond to layers 10, 12, and 14, respectively, of the device of FIG. 1. They may conveniently be formed by consecutive sputtering and may have the same relative thickness described. Layer 26 is an additional zinc oxide layer formed by sputtering over the top of bismuth oxide layer 24. Its thickness should be approximately the same as the thickness of layer 22. Upper electrical contact 28 is a zinc contact which may conveniently be formed by sputtering a layer of zinc on top of layer 26. The device of FIG. 3 is preferably heat treated at a temperature of about 350° C. for between a few seconds and several hours in order to achieve optimum characteristics. Unlike the device of FIG. 1, the symmetrical, nonlinear resistor of FIG. 3 may be essentially fully fabricated prior to heat treatment inasmuch as the silver electrode which is used to contact the bismuth oxide layer of the device of FIG. 1 is not required in the device of FIG. 3. It is not necessary, therefore, to heat treat the partially assembled device, that is to say, prior to applying the silver electrode, followed by the application of the electrode; but rather the entire device with both electrodes attached may be heat treated. In fact, heat treating of the zinc oxide-zinc junction appear to be desirable. The zinc electrode functions through two mechanisms. It acts not only as an ohmic electrode but also acts as a dopant source for the zinc oxide layer during heat treatment. This appears to account for the relatively low resistance between the metallic zinc layer and the zinc oxide layer. It would otherwise be expected that a metal electrode deposited on an n-type semiconductor such as zinc oxide would form a Schottky barrier diode type contact rather than an ohmic contact as is provided by the teachings of this invention. For example, a silver electrode deposited on the n-type zinc oxide layer forms a Schottky diode. Measurement of the zinc-zinc oxide junction confirms that its character is ohmic rather than an exponential current-voltage relationship characteristic of junction diodes. While other electrode materials may be employed as will be apparent to one skilled in the art, the preferred ohmic character of the electrode-zinc oxide layer should be maintained.

Figure 4:
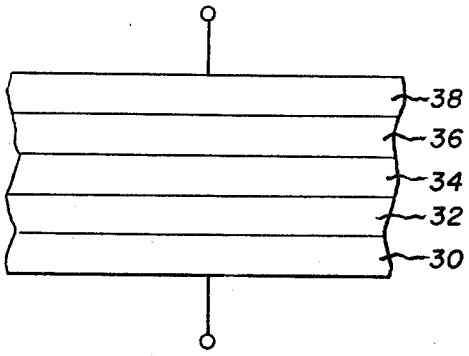
FIG. 4 is a section view of an alternative symmetrical multilayer thin film nonlinear resistor in accordance with this invention.

While the structure of the symmetrical, nonlinear resistor of FIG. 3 is preferred inasmuch as it allows the use of zinc contacts and also allows for heat treating of the device after assembly thereof has been completed rather than at an intermediate stage, nevertheless, this invention contemplates that a nonlinear resistor may be made as illustrated at FIG. 4 wherein the active portion of the device includes a layer of zinc oxide 34 sandwiched by layers of bismuth oxide 32 and 36 to which electrodes 30 and 38, which may conveniently be silver electrodes, are attached.

Where the structure of FIG. 4 is employed it is preferred that the zinc oxide layer be on the order of 1000 Å in thickness and that the layers of bismuth oxide, 32 and 36, be on the order of 1 to several micrometers in thickness. As has been mentioned, the thickness of the bismuth oxide layer as well as that of the other layers comprising the thin film resistor in accordance with this invention is limited on the low side by the ability to form a continuous substantially homogeneous layer and on the high side by increasing resistivity and cost. For the most part, it is preferred to provide a slightly thicker layer than the thinnest layer which may be readily formed in order to insure that the requirements for continuity and homogenity are met, the slight increase in resistance and cost being tolerable.

Figure 5:
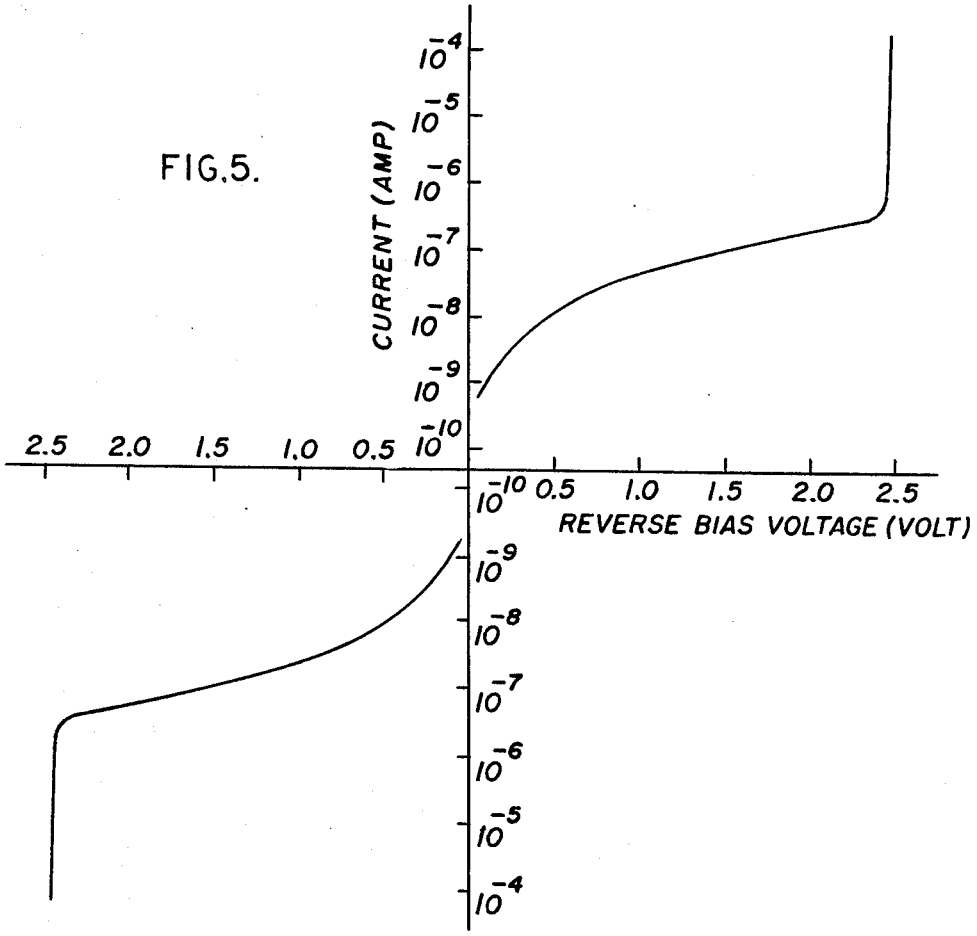
FIG. 5 is a graphical representation of the voltage-current characteristics of the devices of FIGS. 3 and 4.

FIG. 5 is a graphical representation of the current-voltage characteristics of thin film nonlinear resistors of the type illustrated at FIGS. 3 and 4. It will be recognized that the characteristics are symmetrical and in the first quadrant for example, are identical to those hereinbefore discussed with reference to FIG. 2. Inasmuch as the scale of the ordinate is logarithmic, values close to the origin are omitted.

While this invention has been described in conjunction with several exemplary embodiments thereof, it will be apparent to those skilled in the art that many modifications and changes may be made therein without departing from the true spirit and scope of the invention. For example, while a functional embodiment of the invention may be formed with zinc electrodes, improved solderability, for example, may be achieved by providing a silver electrode over the zinc electrode to which electrical leads may be more easily attached. The interposition of a zinc electrode between a silver outer electrode and a bismuth oxide layer eliminates the requirement for heat treating the device prior to the application of the silver layer since reaction between the silver and bismuth oxide layers will be prevented by the intermediate zinc layer. Further, while sputtering may be employed with good results to form the several layers of the structure of this invention, other techniques for forming relatively thin metal layers such as vacuum evaporation including hot filament evaporation or the electron beam evaporation may also be employed. Due regard must be given to the high melting temperatures of certain of the elements of this invention such as zinc oxide and bismuth oxide which may restrict the method for forming layers thereof. Clearly, where decomposition of a compound occurs before melting, then vacuum evaporation techniques may not be employed and sputtering is indicated.

Accordingly, it is intended that the scope of this invention be limited not by the particular advantages thereof hereinabove included, but rather by the appended claims.

What is claimed is:

1. A nonlinear heterojunction resistor comprising in layered relationship:

a thin film layer of a first metal;

a thin film layer of a first metal oxide;

a thin film layer of a second metal oxide;

a thin film layer of a second metal.

2. The device of claim 1 wherein said first metal is zinc.

3. The device of claim 1 wherein said first metal oxide is zinc oxide.

4. The device of claim 1 wherein said second metal oxide is bismuth oxide.

5. The device of claim 4 wherein said second metal is silver.

6. The device of claim 3 wherein said second metal oxide is bismuth oxide and said second metal is silver.

7. The device of claim 6 wherein said bismuth oxide comprises bismuth oxide which has been heat treated to a temperature of at least 350° C.

8. A symmetrical nonlinear heterojunction resistor comprising in layered relationship:

a thin film layer of a first metal;

a thin film layer of a first metal oxide;

a thin film layer of a second metal oxide;

a second thin film layer of said first metal oxide; and a second thin film layer of said first metal.

9. The resistor of claim 8 wherein said first metal oxide is zinc oxide and said second metal oxide is bismuth oxide.

10. The resistor of claim 8 wherein said first metal oxide is bismuth oxide and said second metal oxide is zinc oxide.

11. The resistor of claim 9 wherein said first metal is zinc.

12. The resistor of claim 10 wherein said first metal is silver.

13. The resistor of claim 9 or 10 wherein said bismuth oxide comprises bismuth oxide which has been heat treated at a temperature of at least about 350° C.

14. The resistor of claim 11 wherein said layer of zinc oxide has a thickness of between about 1000 Å and 10,000 Å.

15. The resistor of claim 11 wherein said bismuth oxide layer has a thickness of between about 1000 Å and 10,000 Å.

16. The resistor of claim 10 wherein said bismuth oxide layer has a thickness of between about 1000 Å and 10,000 Å and said zinc oxide layer has a thickness of between 1000 Å and 10,000 Å.

17. A method for making a nonlinear heterojunction resistor comprising:

forming a first thin film layer of a first metal;

forming a second thin film layer of a first metal oxide on said first thin film layer; and forming a third thin film layer of a second metal oxide on said second thin film layer;

heat treating said first, second and third thin film layers at a temperature of at least 350° C.;

forming a fourth thin film layer of a second metal on said third thin film layer.

18. The method of claim 17 wherein said first metal is zinc, said first metal oxide is zinc oxide, said second metal oxide is bismuth oxide and said second metal is silver.

19. A method for forming a symmetrical nonlinear heterojunction resistor comprising:

forming a first thin film layer of a first metal;

forming a second thin film layer of a first metal oxide on said first thin film layer;

forming a third thin film layer of a second metal oxide on said second thin film layer;

forming a fourth thin film layer of said first metal oxide on said third thin film layer;

forming a fifth thin film layer of said first metal on said fourth thin film layer; and heat treating said resistor at a temperature in excess of about 350° C.

20. The method of claim 19 wherein said first metal is zinc, said first metal oxide is zinc oxide and said second metal oxide is bismuth oxide.

* * * * *